US008733069B2

(12) United States Patent
Fischer

(10) Patent No.: US 8,733,069 B2
(45) Date of Patent: May 27, 2014

(54) MULTI-PACK PACKAGING SYSTEM

(75) Inventor: Doug Fischer, Forest Grove, OR (US)

(73) Assignee: J. Lieb Foods, Inc., Forest Grove, OR (US)

( * ) Notice: Subject to any disclaimer, the term of this patent is extended or adjusted under 35 U.S.C. 154(b) by 810 days.

(21) Appl. No.: 12/393,839

(22) Filed: Feb. 26, 2009

(65) Prior Publication Data

US 2010/0212264 A1 Aug. 26, 2010

(51) Int. Cl.
*B65B 35/30* (2006.01)

(52) U.S. Cl.
USPC ..... 53/448; 53/450; 53/543

(58) Field of Classification Search
CPC ..... B65B 5/06; B65B 21/06; B65B 21/18; B65B 21/20; B65B 9/06; B65B 21/02
USPC ..... 53/448, 450, 534, 543, 247
See application file for complete search history.

(56) References Cited

U.S. PATENT DOCUMENTS

| | | | | | |
|---|---|---|---|---|---|
| 2,581,742 | A | | 1/1952 | Young | |
| 2,695,190 | A | | 11/1954 | Meierjohan | |
| 3,209,923 | A | | 10/1965 | Bargel et al. | |
| 3,327,450 | A | * | 6/1967 | Carter | 53/496 |
| 3,505,787 | A | * | 4/1970 | Tiews | 53/539 |
| 3,555,770 | A | | 1/1971 | Rowekamp | |
| 3,555,773 | A | * | 1/1971 | Rowekamp | 53/539 |
| 3,592,000 | A | * | 7/1971 | Kapare | 53/448 |
| 3,601,951 | A | | 8/1971 | Bargel et al. | |
| 3,865,943 | A | | 2/1975 | Merz et al. | |
| 3,934,920 | A | * | 1/1976 | Rowekamp | 294/87.1 |
| 4,048,780 | A | * | 9/1977 | Chenevard | 53/448 |
| 4,055,943 | A | * | 11/1977 | Reichert | 53/247 |
| 4,209,293 | A | | 6/1980 | Sugai et al. | |
| 4,411,574 | A | * | 10/1983 | Riley | 414/796.3 |
| 4,802,324 | A | * | 2/1989 | Everson | 53/398 |
| 4,901,504 | A | * | 2/1990 | Tsuji et al. | 53/247 |
| 5,257,888 | A | * | 11/1993 | Kronseder | 414/416.06 |
| 5,611,193 | A | * | 3/1997 | Farrelly | 53/475 |
| 6,793,064 | B2 | * | 9/2004 | Schoeneck et al. | 198/419.3 |
| 7,357,243 | B2 | | 4/2008 | Weaver et al. | |
| 2005/0262814 | A1 | | 12/2005 | Battisti | |

OTHER PUBLICATIONS

Drawing of OCME model AVL40 + ALV; serial No. 1/037/94 showing a schematic illustration of a wrap-around packing machine in use before Feb. 26, 2008.

* cited by examiner

*Primary Examiner* — Sameh H. Tawfik
(74) *Attorney, Agent, or Firm* — Klarquist Sparkman, LLP

(57) ABSTRACT

Methods and apparatus for combining units from among a plurality of packages are disclosed. In some embodiments, units are combined from a plurality of single-variety packages to provide one or more variety packs. For example, a plurality of single-variety packages arranged in repeating order of variety can be provided. The single-variety packages being so arranged can define at least two lanes extending among the plurality of single-variety packages. At least one single-variety group of units can be selected from at least one of the plurality of single-variety packages. Each of the selected at least one single-variety group of units can be positioned in one of the lanes. The selected at least one single-variety group of units can be repositioned to another package and within the one of the lanes.

19 Claims, 8 Drawing Sheets

MULTI-PACK PACKAGING SYSTEM

FIELD

This disclosure generally relates to packaging and more specifically to a method and apparatus for packaging separate, distinct articles, such as beverages or food products, packaged in single-variety packaging into variety packs containing more than one variety.

BACKGROUND

As used herein, a "variety pack" means a package containing at least two different varieties of a product or article.

Products typically are packaged together in single-variety packages. For example, soft drinks and other beverages are often packaged in single-variety packages of several individual beverage containers (e.g., a "six-pack" usually has six individual containers of a single beverage variety, a "case" usually has twenty-four individual containers of a single beverage variety). Accordingly, consumers who wish to purchase more than one type of soft drink (for example) must purchase at least two individual soft drinks, at least two six-packs or at least two cases.

Some products, including soft drinks, are re-packaged into variety packs. For example, beverage distributors are known to repackage beverages cases by removing beverages from single-variety cases, sorting and repackaging the beverages in variety pack packaging (variety packs). However, previous methods of repackaging multiple varieties of beverages have been inefficient, and apparatus used to automate these inefficient methods have been costly to build, maintain and operate.

SUMMARY

For ease of illustration, one exemplary embodiment will be described at the outset. In the one exemplary embodiment, four flavors of bottled juices, each packed in a separate case containing four longitudinal rows of six bottles each, are automatically sorted and repackaged in multi-variety cases containing six bottles of each flavor.

In the initial set up, single-flavor cases are arranged end-to-end on a conveyor in a repetitive pattern of Flavor 1-2-3-4, 1-2-3-4 . . . . As part of the initial set up, longitudinal rows of bottles are selectively removed from the first four cases to be reconfigured as variety-pack cases. Three rows of bottles (corresponding to rows of three different flavors in one repackaged multi-pack) are removed from the first (lead) case to leave three vacant rows, two rows (corresponding to rows of two different flavors in one repackaged multi-pack) are removed from the second case to leave two vacant rows, one row (corresponding to a row of a different flavor in one repackaged multi-pack) is removed from the third case to leave one vacant row, and no rows are removed from the fourth single-flavor case.

After the initial set up, the conveyor automatically advances the aligned cases a distance preferably of about four case-lengths to position the first four cases at a loading station or zone, where each case has a different number of vacant rows ranging from three in the lead case to zero in the last. At this juncture, the next group of four single-flavor cases in line on the conveyor are fully loaded with four longitudinal rows of six bottles. Subsequently, in a loading sequence one row (row number 1, for example) of bottles in each case remains fixed while remaining rows 2, 3 and 4 (for example) automatically advance. Linear actuators positioned above rows 2, 3 and 4 automatically pick up, advance and deposit into upstream cases preselected rows of bottles in accordance with instructions from a control system. Specifically, during this sequence no actuator removes bottles from the lead case which has only one row of bottles. An actuator aligned with the second row simultaneously engages groups of six bottles from cases 2, 3, 4 and 5 and advances each group by one case (from cases 2, 3, 4, 5 to cases 1, 2, 3, 4). An actuator aligned with the third row simultaneously engages four groups of six bottles associated with cases 3, 4, 5 and 6 and advances each group by two cases (from cases 3, 4, 5, 6 to cases 1, 2, 3, 4, respectively). An actuator aligned with the fourth row simultaneously engages four groups of six bottles associated with cases 4, 5, 6 and 7 and advances each group by three cases (from cases, 4, 5, 6 and 7 to cases 1, 2, 3 and 4, respectively). Since the actuators travel different distances as part of the advancing step, they preferably travel at different speeds so that they each pick up and deposit their respective rows of bottles at about the same time. During the shuffling sequence, the lead case only receives rows of bottles, some cases (2, 3, 4) both lose and receive rows of bottles, and some cases (5, 6, 7) only lose rows of bottles.

Once the first four cases are each fully loaded with four longitudinal rows of distinct flavors, they are automatically advanced by the conveyor out of the loading zone as the next four cases are moved into position to repeat the shuffling cycle. The advanced cases in the loading zone have been preconditioned for multi-pack loading because they each have a different number of vacant rows ranging from "0" to "3" by virtue of the prior shuffling cycle. The cycle then automatically repeats without the need for any initial set up step.

Multi-pack packaging systems for combining beverages packaged in two or more longitudinally aligned packages into one or more multi-pack containers are disclosed. Some multi-pack packaging systems comprise a conveyor for conveying each package and multi-pack container along a longitudinal axis of the conveyor with the beverages arranged in the packages in at least two longitudinally extending rows. In these systems, one or more linear actuators are capable of being positioned above and in vertical alignment with a respective row of beverages. Each actuator has an advancing mechanism to grip a plurality of beverages in one row, lift and advance the beverages along the axis of the conveyor, and then deposit the beverages into each multi-pack container located downstream. A control system can be incorporated to control each actuator so as to advance and deposit beverages from the packages into each multi-pack container.

Methods for packaging beverages are also disclosed. For example, at least two containers, each containing at least two rows of beverages with at least two beverages in each row, can be positioned in a longitudinally aligned manner. The containers can include an upstream multi-variety container and at least one single-variety downstream container. At least one row of beverages can be simultaneously removed from the upstream multi-variety container to leave at least one vacant longitudinally extending row. At least one row of beverages can be removed and advanced from each downstream single-variety container, and each advanced row of beverages can be deposited into a corresponding vacant row in the multi-variety container.

Multi-pack packaging apparatus for combining units selected from a plurality of packages into at least one package are disclosed. Such apparatus comprise a conveyor for conveying two or more packages. The packages can be arranged to define two or more lanes extending among the two or more packages. Some of these apparatus also include a two-degrees-of-freedom linear actuator. Such an actuator can be configured to translate along each of two axes-of-movement and to engage at least one group of units selected from at least one of the packages and positioned in one of the lanes. One of the axes-of-movement, at least a segment of the conveyor, and the two or more lanes can be substantially parallel. The actuator can be configured to reposition the selected at least one group of units within one of the lanes.

The two-degrees-of-freedom linear actuator can comprise a vertically movable carriage and one or more horizontally movable actuators having at least one group of engaging members for engaging the selected at least one group of units. Each of the one or more actuators can be positioned and horizontally movable above one corresponding lane. The at least one group of engaging members can comprise four groups of engaging members configured to engage a corresponding four groups of units. The one or more horizontally movable actuators can comprise at least three horizontally movable actuators. Each of the horizontally movable actuators can be positioned above a corresponding one of the lanes.

A first actuator can be configured to travel at about a first speed, a second actuator can be configured to travel at about twice the first speed, and a third actuator can be configured to travel at about three-times the first speed.

Methods for combining units from among a plurality of packages are disclosed. In some methods, a plurality of packages defining at least two lanes extending among the plurality of packages is provided. Each package can contain one or more units positioned within at least one of the lanes. At least one of the one or more units can be selected as at least one group of units. The selected group of units can be repositioned to another package and within each corresponding at least one of the lanes.

The act of selecting the at least one group of units can comprise the act of selecting at least one array of single-variety groups of units. The at least one array of single-variety groups of units can comprise at least four single-variety groups of units. Each of these single-variety groups of units can comprise a distinct variety of unit.

The act of selecting at least one array can comprises selecting at least two arrays. Each of the arrays can comprise at least two groups of units. Each of the groups of units corresponding to a given one of the at least two arrays can comprise a distinct variety of unit.

The act of repositioning the selected at least one single-variety group of units can comprise engaging the selected at least one single-variety group of units and lifting the selected at least one single-variety group of units. The selected at least one group of units can be moved from above one package position to above another package position. The selected at least one group of units can also be released.

The plurality of packages can comprise at least seven single-variety packages.

The act of selecting at least one array can comprise selecting at least three arrays. At least one of the at least one array can comprise four single-variety groups of units. In some embodiments, each of three of the at least three arrays comprise four single-variety groups of units. Each single-variety group of units can comprise six units.

In some exemplary methods, at least one of the at least one array is brought into alignment with at least one other array. The at least one array can be released to form at least one variety pack.

The act of selecting at least one group of units can comprise the act of selecting one fewer arrays of groups than there are lanes. The act of repositioning the selected at least one group of units can comprise the act of shifting each of the selected arrays of groups within each corresponding lane. The selected arrays can be substantially simultaneously released.

The act of shifting each of the selected arrays can comprise shifting a first array by about a distance spanned by one group and shifting a second array by about a distance spanned by two groups. An $(N-1)^{th}$ array can be shifted by about a distance spanned by (N−1) groups, with N being the number of lanes.

The act of shifting a first array by about a distance spanned by one group and shifting a second array by about a distance spanned by two groups can comprise translating the first array at a first speed. The second array can be translated at a speed being about twice the first speed. An $(N-1)^{th}$ array can be translated at a speed being about (N−1) times the first speed.

Multi-pack packaging apparatus for providing M variety packs are disclosed. Each of the M variety packs can comprise N single-variety groups of physical articles. These apparatus comprise a conveyor for conveying (M+N−1) single-variety sets of physical articles. Each $i^{th}$ single-variety set can comprise i groups of physical articles, with i being an integer ranging from 1 to N. If M is greater than 1, each $k^{th}$ single-variety set comprises N groups of physical articles, with k being an integer ranging from (N+1) to (M+N−1). These apparatus also comprise a two-degrees-of-freedom linear actuator configured to select N−1 arrays of M groups of physical articles. Each of the (N−1) arrays defines a corresponding lane. The actuator is configured to shift each $j^{th}$ array by about a distance spanned by j single-variety sets within each corresponding $j^{th}$ lane, with j being an integer ranging from 1 to (N−1).

In some exemplary multi-pack packaging apparatus, the two-degrees-of-freedom linear actuator comprises a vertically movable carriage and (N−1) horizontally movable linear actuators. Each of the (N−1) horizontally movable linear actuators can be configured to engage one array of M groups of physical articles. A first horizontally movable actuator can be configured to shift a corresponding array of M groups at a first speed. Each $j^{th}$ actuator can be configured to shift the corresponding $j^{th}$ array at about j-times the first speed.

Other multi-pack packaging apparatus are disclosed that include a two-degrees-of-freedom linear actuator, and a conveyor. The multi-pack packaging apparatus can be configured to shuffle units from at least one package to at least one other package by performing a shuffling method as disclosed herein. The shuffling method includes conveying (M+N−1) packages of units. Each $i^{th}$ package comprises i groups of units, with i being an integer ranging from 1 to N. If M is greater than 1, each $k^{th}$ package comprises N groups of units, with k being an integer ranging from (N+1) to (M+N−1). The shuffling method also includes selecting N−1 arrays of M groups. Each array defines a corresponding lane extending among the packages. The shuffling method also includes shifting each selected $j^{th}$ array by about a distance spanned by j packages within each corresponding $j^{th}$ lane, with j being an integer ranging from 1 to (N−1).

Methods for providing M variety packs are disclosed. Each variety pack can comprise N single-variety groups of physical articles. (M+N−1) single-variety sets of physical articles arranged in repeating order of variety can be provided. Each $i^{th}$ single-variety set comprises i groups of physical articles, with i being an integer ranging from 1 to N. If M is greater than 1, each $k^{th}$ single-variety set comprises N groups of physical articles, with k being an integer ranging from (N+1) to (M+N−1). N−1 arrays of M groups can be selected. Each array defines a corresponding lane extending among the sets.

Each selected $j^{th}$ array can be shifted by j sets within each corresponding $j^{th}$ lane, with j being an integer ranging from 1 to (N−1).

The M variety packs can be secured for shipping. Each physical article can comprise a packaged beverage. M can be any selected integer, for example an integer ranging from 1 to 100, such as an integer ranging from 1 to 8. N can be any selected integer greater than 2, such as an integer ranging from 2 to 100, with an integer ranging from 2 to 8 being but one example.

The foregoing and other features and advantages will become more apparent from the following detailed description, which proceeds with reference to the accompanying drawings.

BRIEF DESCRIPTION OF THE DRAWINGS

FIG. 6B also shows a subsequent sequence of single-variety packages before undergoing a shuffling method.

DETAILED DESCRIPTION

Figure 1A:
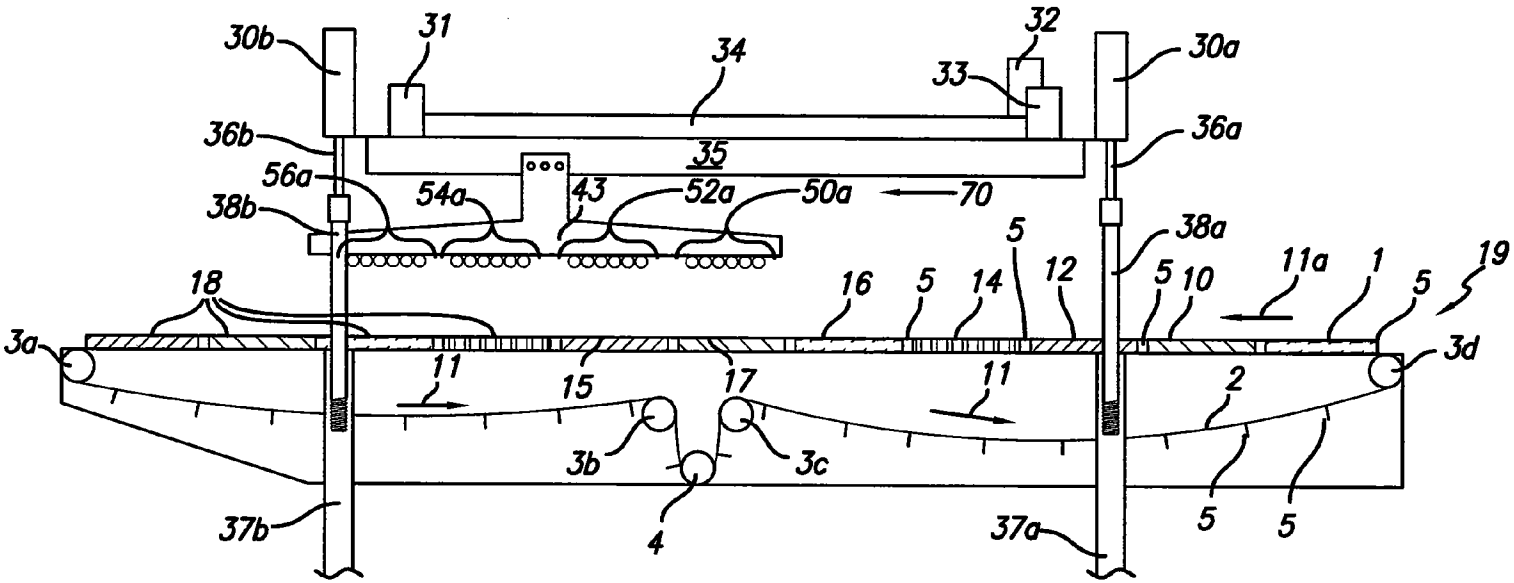
FIG. 1A illustrates a side elevation view of an apparatus for combining units from a plurality of packages. The apparatus is shown in a home position.

The following describes embodiments of apparatus for and methods of combining units from among a plurality of packages, such as combining units to form variety packs. Some embodiments described below are described in the context of combining groups of different flavors of a beverage to form a variety pack of the beverage, although these embodiments (and this disclosure) can be used in many other contexts. For example, the methods described below can provide a variety pack of any type of material, good or article.

Introduction

Products (e.g., goods, articles, materials) are often packaged with like products, and in many instances, product units packaged together in a given package are identical (or substantially identical) to the other product units within the respective package. Such packages are referred to herein as "single-variety packages." For example, individual beverage containers containing a particular beverage are often packaged with other substantially identical beverage containers containing the particular beverage. Commonly available beverages, such as for example soft drinks, are often packaged in sets of six (e.g., "six-packs"), twelve (e.g., "twelve-packs") and twenty-four (e.g., "cases") individual and substantially identical units.

But, single-variety packages may not satisfy all customers. Consequently, beverages can be repackaged from single-variety packages into one or more multi-packs, or variety packs, of the beverages. These variety packs can comprise previously packaged units (e.g., as by repackaging units from among two or more single-variety packages. In addition, manufacturers, distributors and retailers of various products can provide variety packs to their respective customers by combining more than one variety of product in a single package. Accordingly, a variety pack can combine more than one type of good in a single package (such as, for example, sports balls and hammers).

Definitions

To facilitate the description of apparatus and methods for shuffling beverages, for example, several terms will be defined.

As used herein, "unit" means a single part of something larger. For example, a single beverage container in a six-pack is a unit. Alternatively, the six-pack packaged with three other six-packs in a case is also a unit.

As used herein, "group" means one or more units.

As used herein, "array" means one or more groups.

As used herein, "variety pack" means a packaged set of goods, articles or materials comprising more than one variety of goods, articles or materials. A six-pack having at least one container of each of at least two beverages is one example of a variety pack. A package of a plurality of each of several different types of screws is another exemplary variety pack.

As used herein, "repeating order of variety" means a sequence of repeating sub-sequences of multiple varieties of one or more products arranged such that each of the multiple varieties appears in the sub-sequence at least once before the sub-sequence is repeated. For example, four varieties (A, B, C and D) can be arranged in a repeating order of variety as follows: A, B, C, D, A, B, C, D, . . . . This example repeats the sequence "A, B, C, D." These varieties can be arranged in another exemplary repeating order of variety as follows: C, C, A, D, B, C, C, A, D, B . . . . This example repeats the sub-sequence "C, C, A, D, B."

Exemplary Apparatus

Overview

An exemplary apparatus for carrying out one or more of the methods described herein is illustrated in FIGS. 1A, 2A, 3A, 4A, 5A and 6A in various positions. FIGS. 1C and 2C illustrate exemplary actuator positions, and will be described in more detail below.

Figure 2C:
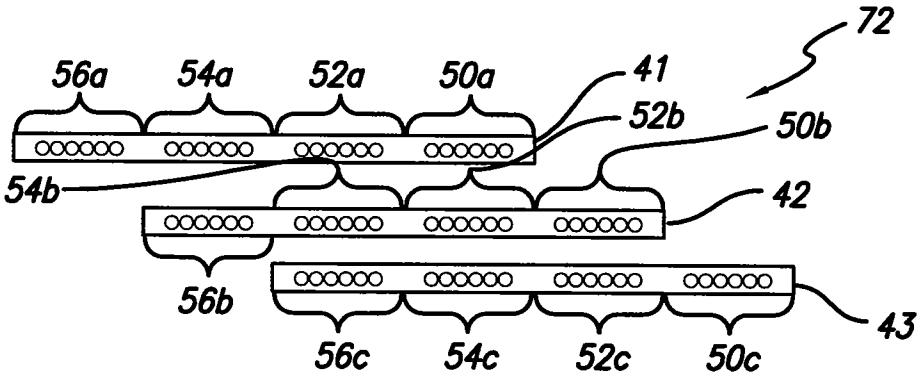
FIG. 2C illustrates a top plan view of the several actuators shown in FIG. 1C. The actuators are positioned in a staggered selection arrangement, as in FIG. 2A.

As shown in FIG. 1A, the exemplary apparatus can comprise a two-degrees-of-freedom linear actuator having a vertically movable carriage 35 (a first degree-of-freedom) suspended above a conveyor 19 for conveying packages (e.g., full single-variety packages 1, 10, partially full single-variety packages 12, 14, 16, and variety packs 15, 17, 18). One or more horizontally movable linear actuators configured for engaging one or more individual units in each of the respective packages can be longitudinally movable (a second degree-of-freedom) relative to the carriage 35 and the conveyor 19. The illustrated embodiment has three such horizontally movable linear actuators 41, 42, 43 (See FIG. 2A).

Accordingly, the exemplary apparatus shown in FIG. 1A provides each of the actuators 41, 42, 43 with two-degrees-of-freedom of linear motion (e.g., vertical motion by movement of the carriage 35, and horizontal motion by movement of the actuators relative to the carriage). A controller 34 can provide control signals to the linear actuators for carrying out the above-described methods.

As shown, the carriage 35 can be longitudinally aligned relative to the conveyor 19 such that longitudinal movement of the actuators 41, 42, 43 relative to the carriage 35 moves the actuators substantially parallel to a longitudinal dimension of the conveyor. A sequence of packages on the conveyor can define lanes extending among the packages, and each of the exemplary actuators 41, 42, 43 can be longitudinally aligned above and parallel to a respective one of the lanes 62, 63, 64. Accordingly, longitudinal movement of the exemplary actuators 41, 42, 43 along the carriage 35 can result in parallel longitudinal movement of the actuators above the respective lanes 62, 63, 64.

Each of the actuators 41, 42, 43 can be configured (see below) for engaging one or more individual units located in a package placed on the conveyor 19. Accordingly, the apparatus can lift units from one or more packages, longitudinally shift the units among the packages, and lower the shifted units into one or more different packages. For example, the carriage 35 can lower the actuators 41, 42, 43 into an engagement position (see for example FIG. 3A). The actuators can engage respective individual units from among, for example, four packages (e.g., the first actuator 41 can engage one group of units in each respective package 1, 10, 12, 14). The carriage 35 can lift the actuators and any correspondingly engaged units (see for example FIG. 4A). The actuators can then shift longitudinally relative to the carriage 35, carrying the units within the lanes (see for example FIG. 5A) to place each group of units above a different package than the package from which the respective group was extracted, and the carriage 35 can lower the actuators and corresponding units to the different packages. The actuators can disengage the units (see for example FIG. 6A), allowing the units to separate from the actuators and completing shuffing of units from one package to another.

Actuators

As noted, the actuators 41, 42, 43 can be movably coupled to the carriage 35 such that each actuator can move linearly along the carriage independently of the other actuators. For example, each respective actuator can be mounted to a separate belt drive (such as a belt drive available from INA, model number MLF52-1452RAR) and driven by a separate servomotor (e.g., an Allen-Bradley servo motor, model number MPLB4540F-SK22AA), or a stepper motor, etc.

In FIGS. 1A and 1C, the actuators are shown in longitudinal alignment with each other in an exemplary home position 70. Each actuator can be longitudinally movable relative to the carriage 35, and in FIGS. 2A and 2C, the actuators 41, 42, 43 are shown in a staggered selection position 72 after having moved longitudinally relative to the carriage 35 from the home position 70.

With reference to FIGS. 1C and 2C, each actuator (e.g., actuator 43) can define an array (e.g., array 58*a*) comprising one or more groups (e.g., group 56*a*) of one or more individual unit engaging members (e.g., member 55*a*). Each unit engaging member can comprise a pliable suction cup coupled to a vacuum source, and can be configured to overlap a top-portion of a beverage container, such as a plastic bottle. Such a pliable suction cup can be sized to sealingly engage an outer surface of the beverage container. Drawing a vacuum within the pliable suction cup while simultaneously engaging a bottle can enhance the engagement between the suction cup and the bottle. A unit engaging member so configured can lift a corresponding beverage container from its package against the pull of gravity and other forces, such as forces resulting from movement of the carriage 35 and actuators as the beverage containers are lifted and advanced.

After an array of beverage containers or other units is lifted from one or more corresponding packages by an actuator, the actuator can shift longitudinally relative to the carriage 35, carrying with it the lifted array longitudinally of the conveyor 19. Upon releasing a vacuum (or performing another unit disengaging act well known in the art), the lifted array can disengage from the actuator for placement in a package, as by falling under the force of gravity.

Vertically Movable Carriage

As noted above, the carriage 35 can be vertically movable relative to, and suspended above, the conveyor 19. The illustrated apparatus has pairs of upright cylinder members 38*a*, 38*b* and corresponding pairs of piston members 36*a*, 36*b* for moving the carriage 35 vertically. The respective pairs of upright cylinder members 38*a*, 38*b* can straddle the conveyor 19, and can be located near opposing ends of the carriage 35, as shown in FIG. 1A. The illustrated pairs of cylinder members 38*a*, 38*b* are stationary relative to the corresponding pairs of legs 37*a*, 37*b* that rest on the floor or other stationary frame of reference. The corresponding piston members 36*a*, 36*b* are configured to move vertically relative to the cylinder members 38*a*, 38*b* so as to raise and lower the carriage 35 evenly. In other words, the carriage lifting apparatus that lifts the carriage 35 moves the carriage vertically with substantially no other motion (e.g., substantially no translation forward or backward, or side-to-side relative to the conveyor 19, and with substantially no pitch, yaw or roll). In the illustrated embodiment, pairs of air cylinders 30*a*, 30*b* (e.g., Parker air cylinders, model number 3.25CI4MA2US34AC45) are configured to pneumatically raise and lower the respective pairs of piston members 36*a*, 36*b* within cylinder members. For example, some air cylinders are two-stage air cylinders that travel a first distance in one direction and a second distance in the opposite direction. Such two-stage air cylinders can reduce the likelihood of jamming of articles in shifting and repositioning maneuvers. Adjustable legs 38*a*, 38*b* can be used to adjust the height of the carriage over the conveyor for accommodating various height packages.

Although the embodiments shown in FIG. 1A have a total of four upright cylinder members and four corresponding piston members, other embodiments of the carriage lifting apparatus can have two, three, five or more individual devices for raising and lowering the carriage 35. In still other embodiments, the carriage 35 is suspended from above, e.g., suspended from an overhead structure, such as a roof truss (not shown), instead of being supported from below as in FIG. 1A. Sensors can be used to provide closed-loop control feedback to a controller 34 concerning the position of the carriage 35 or any of the actuators 41, 42, 43.

Conveyor

The conveyor 19 shown in FIG. 1 can travel counterclockwise, as indicated by the arrows 11, 11*a*. Accordingly, when the conveyor moves, the packages being conveyed move from right to left, as indicated by the arrow 11*a*.

In some embodiments, the conveyor 19 can be a single conveyor belt, as with the conveyor shown in FIG. 1. For example, the conveyor 19 can be a continuous belt driven by a powered drive-pulley 4, and be supported and/or guided by one or more idler pulleys 3*a*, 3*b*, 3*c*, 3*d*. In some embodiments, the conveyor 19 can also have one or more index members 5 for aligning and/or spacing the packages on the conveyor so as to be compatible with a stroke of the respective actuators 41, 42, 43 used to shift units among packages. The conveyor 19 can comprise a plurality of conveyor belts without departing from the concepts presented here.

Exemplary Method of Use

The exemplary apparatus just described can carryout one or more of the shuffling methods disclosed herein. In FIG. 1A, the apparatus is shown in a starting position. The actuators 41, 42, 43 are in a home position 70 at one end of the carriage 35. The carriage 35 is in a raised position, and the conveyor 19 has a sequence of packages arranged in a repeating order of variety (see for example FIG. 1B and the related discussion above). The first actuator 43 is aligned above the second lane 62, the second actuator 42 is aligned above the third lane 63 and the third actuator 43 is aligned above the fourth lane 64. As shown in FIG. 1C, the several actuators 41, 42, 43 are longitudinally aligned with each other when in the home position 70.

Figure 1B:
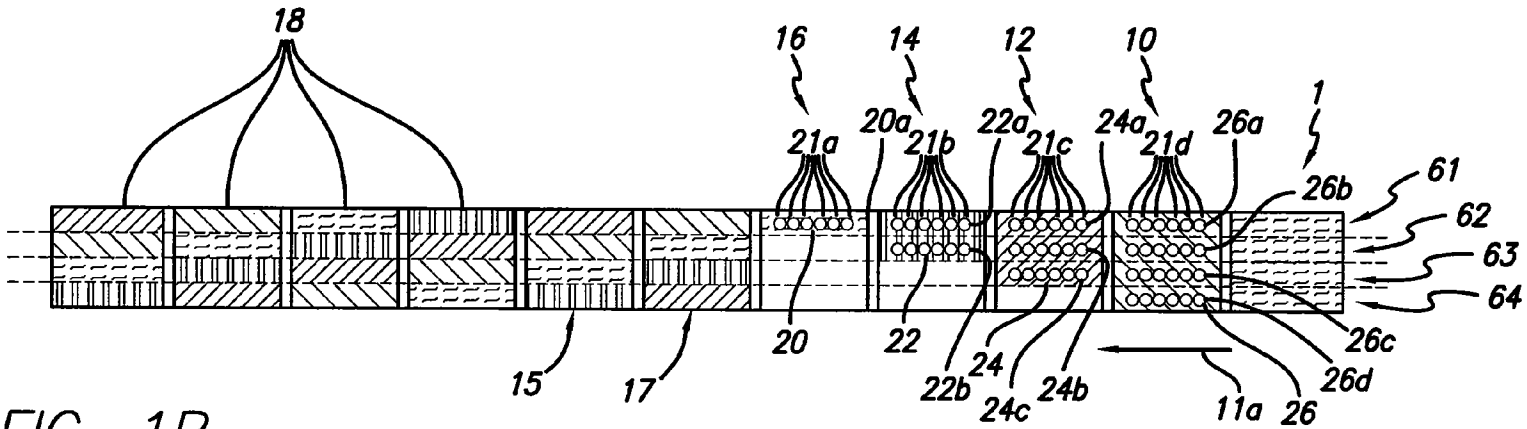
FIG. 1B illustrates a top plan view of a sequence of single-variety packages arranged in a repeating order of variety before undergoing a combinatorial (e.g., shuffling) method, as well as several variety packs.
Figure 1C:
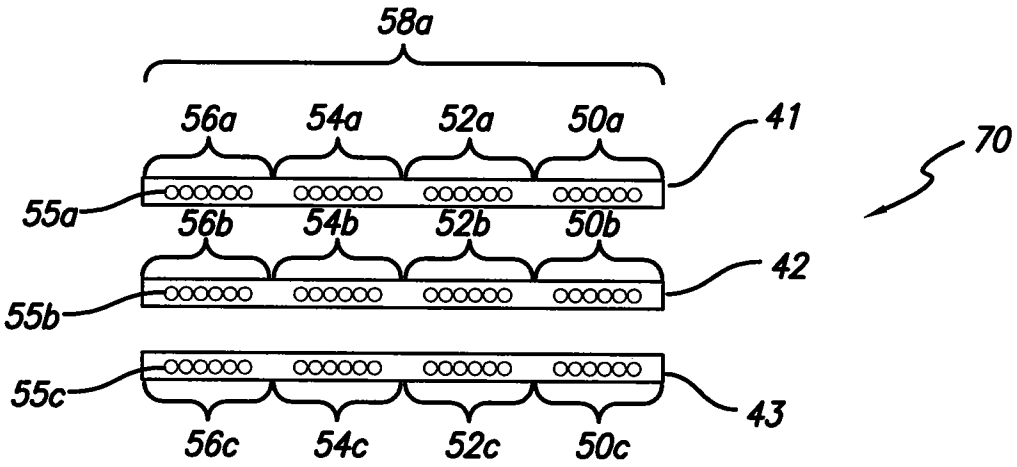
FIG. 1C illustrates a top plan view several actuators for selecting groups of units from packages and repositioning the selected groups. The actuators are shown in a home position.
Figure 2A:
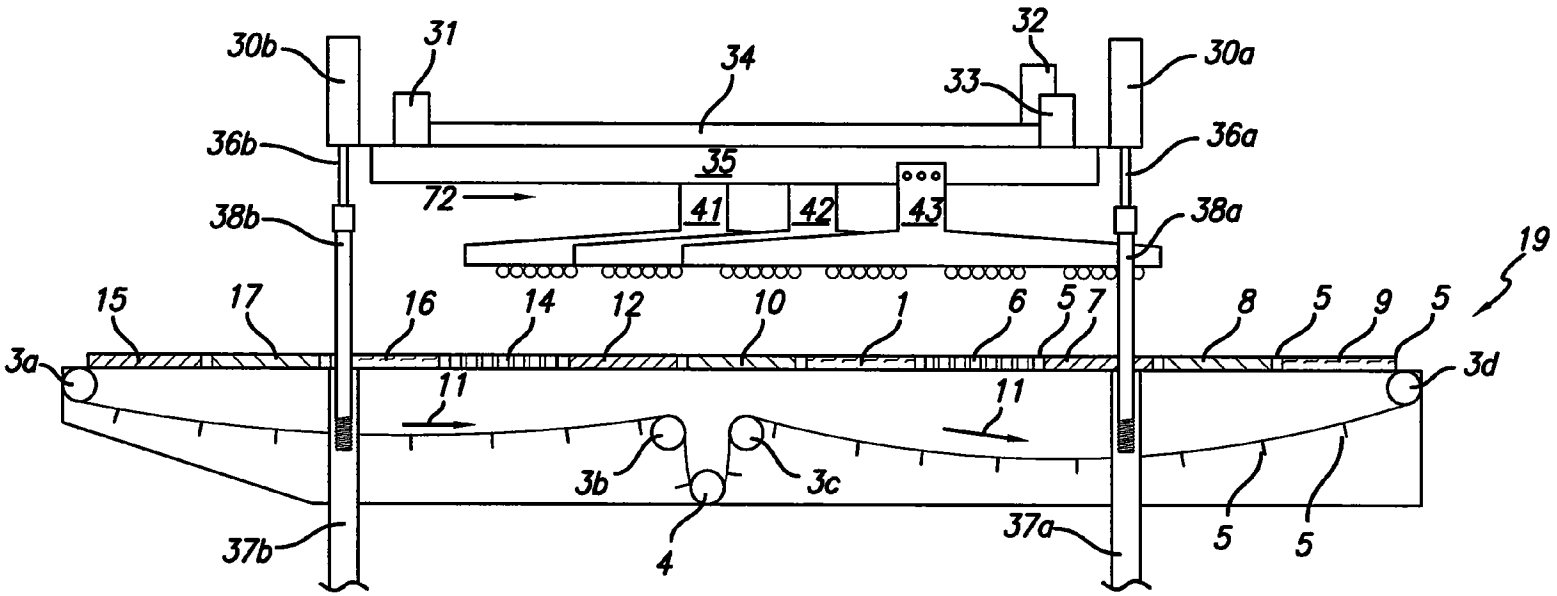
FIG. 2A illustrates a side elevation view of the apparatus shown in FIG. 1A after the actuators shown in FIG. 1C have been positioned in a staggered selection arrangement.

In FIG. 2A, the apparatus has moved to a preliminary selection arrangement. The conveyor 19 has advanced the sequence of packages by a distance spanned by four packages (for example, compare the relative package positions shown in FIGS. 1B and 2B). In this embodiment, the linear actuators 41, 42, 43 are staggered (see FIGS. 2A and 2C) when in a selection position 72. Although each actuator can travel at approximately the same speed, the first actuator 41 travels approximately the distance spanned by one package and the third actuator 43 travels approximately the distance spanned by three packages when moving from a home position 70 to a staggered selection position 72 (see FIGS. 1C and 2C). Accordingly, if the actuators travel at the same speed, the first actuator will arrive at the selection position 72 before the second and third actuators 42, 43. In some instances (as in at least one working embodiment), the actuators arrive in the selection position 72 at about the same time by travelling at different speeds, for example, by moving the third actuator 43 at about three times the speed of the first actuator 41.

Figure 3A:
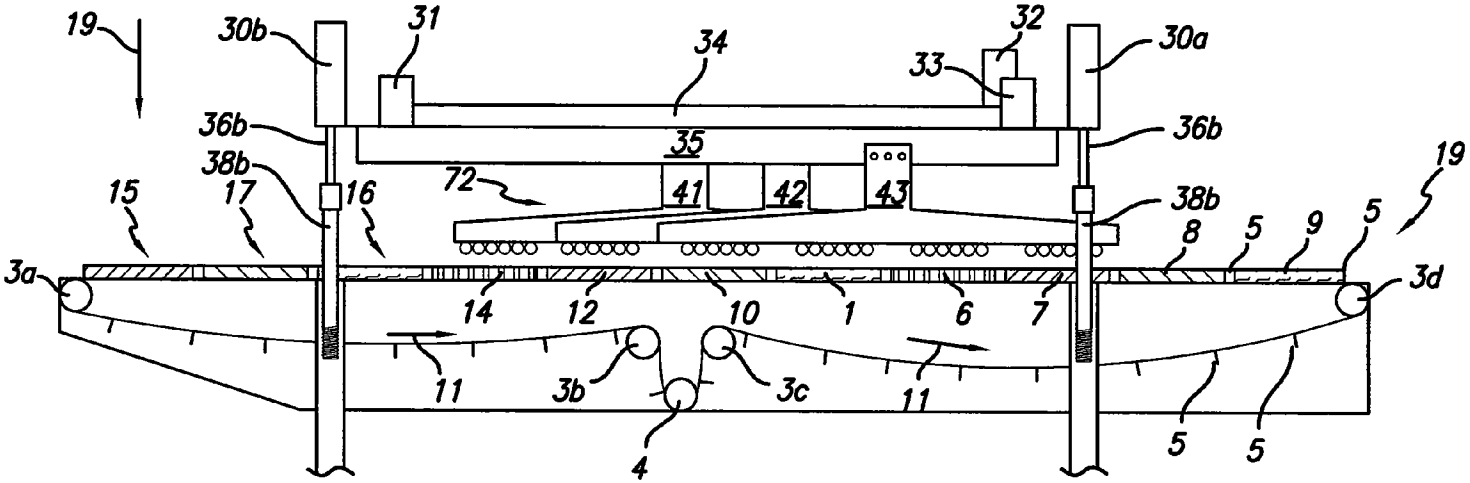
FIG. 3A illustrates a side elevation view of the apparatus shown in FIG. 1A with the actuators shown in FIGS. 1C and 2C in a selection position.

In FIG. 3A, the carriage 35 has lowered the actuators into an engagement position. In this position, the arrays of engaging members corresponding to each of the actuators 41, 42, 43 engage respective arrays of packaged units. For example, the array of engaging members 58*a* corresponding to the first actuator 41 (groups 56*a*, 54*a*, 52*a*, 50*a*) engage a corresponding array of packaged units (groups 22*b*, 24*b*, 26*b*, 1*b*, respectively). Similarly, the engaging member groups 56*b*, 54*b*, 52*b*, 50*b* of the second actuator engage the groups of units 24*c*, 26*c*, 1*c*, 6*c*, respectively; and the engaging-member groups 56*c*, 54*c*, 52*c*, 50*c* of the third actuator 43 engage the groups of units 26*d*, 1*d*, 6*d*, 7*d*, respectively.

Figure 4A:
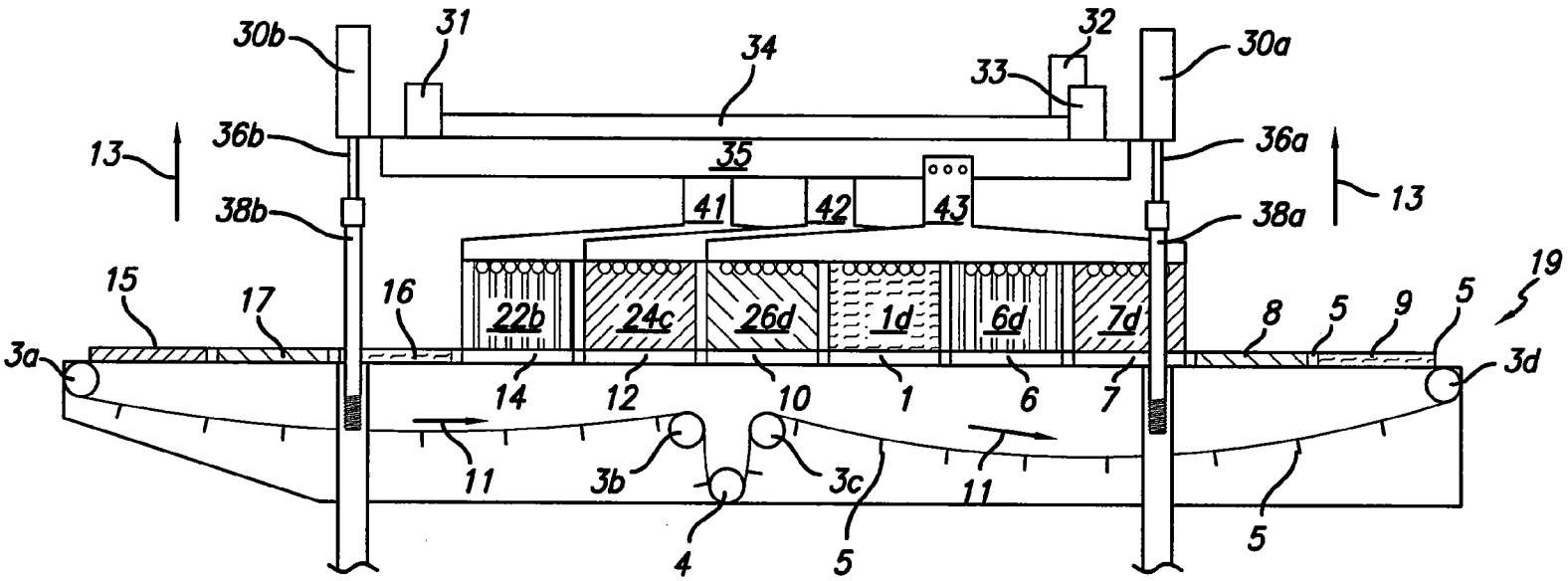
FIG. 4A illustrates a side elevation view of the apparatus shown in FIG. 1A. The actuators shown in FIGS. 1C and 2C are in an extraction position relative to the packages.

In FIG. 4A, the carriage 35 has been raised vertically, as indicated by the arrow 13, and the engaged groups of units have been lifted from their respective packages (e.g., packages 1, 6, 7, 10, 12, 14).

Figure 5A:
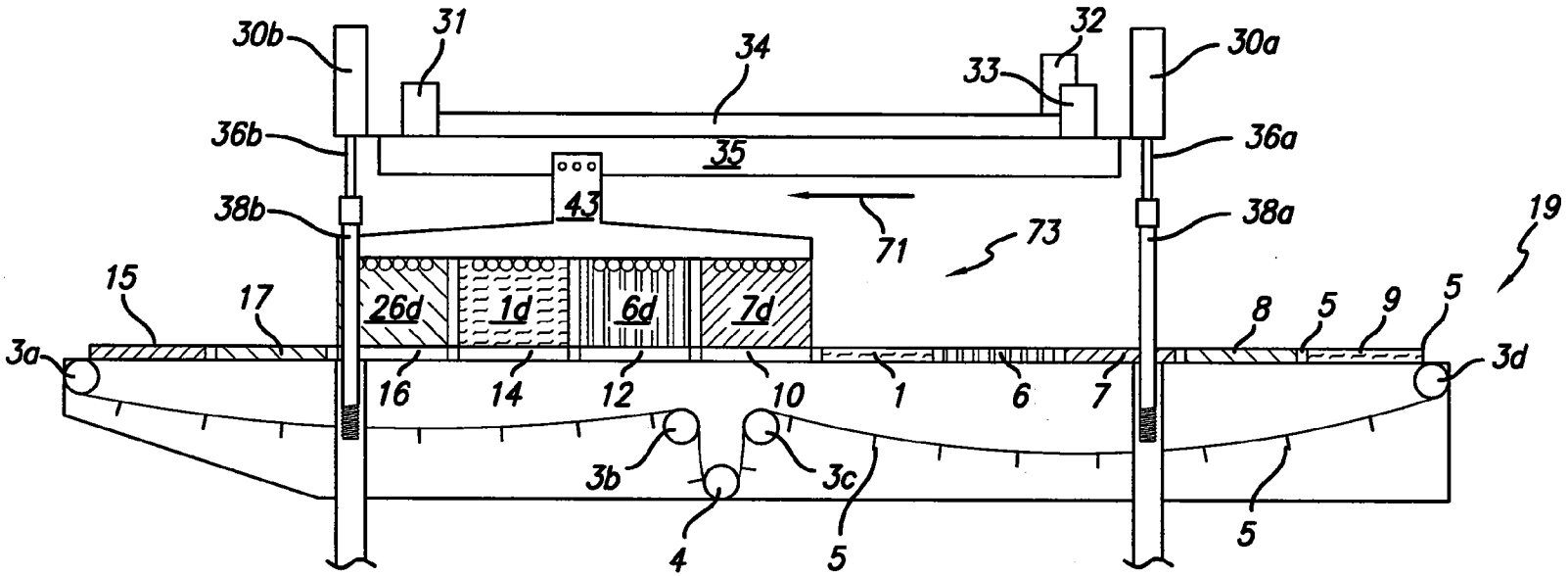
FIG. 5A illustrates a side elevation view of the apparatus shown in FIG. 1A. The actuators shown in FIGS. 1C and 2C are shown positioned in a home position and engaging extracted units. The extracted units have been repositioned relative to the packages from which they were extracted.

In FIG. 5A, the actuators have moved into an actuator release position 73 (e.g., translated from right to left as indicated by the arrow 71). As when moving the actuators 41, 42, 43 into a selection position, each actuator can travel at approximately the same speed. Again, since the first actuator 41 travels approximately the distance spanned by one package and the third actuator 43 travels approximately the distance spanned by three packages, the first actuator can arrive at the release position 73 first if the actuators travel at the same speed. Alternatively, the actuators can arrive at the release position 73 at about the same time by translating the actuators at different speeds, for example, by moving the third actuator 43 at about three times the speed of the first actuator 41.

Figure 6A:
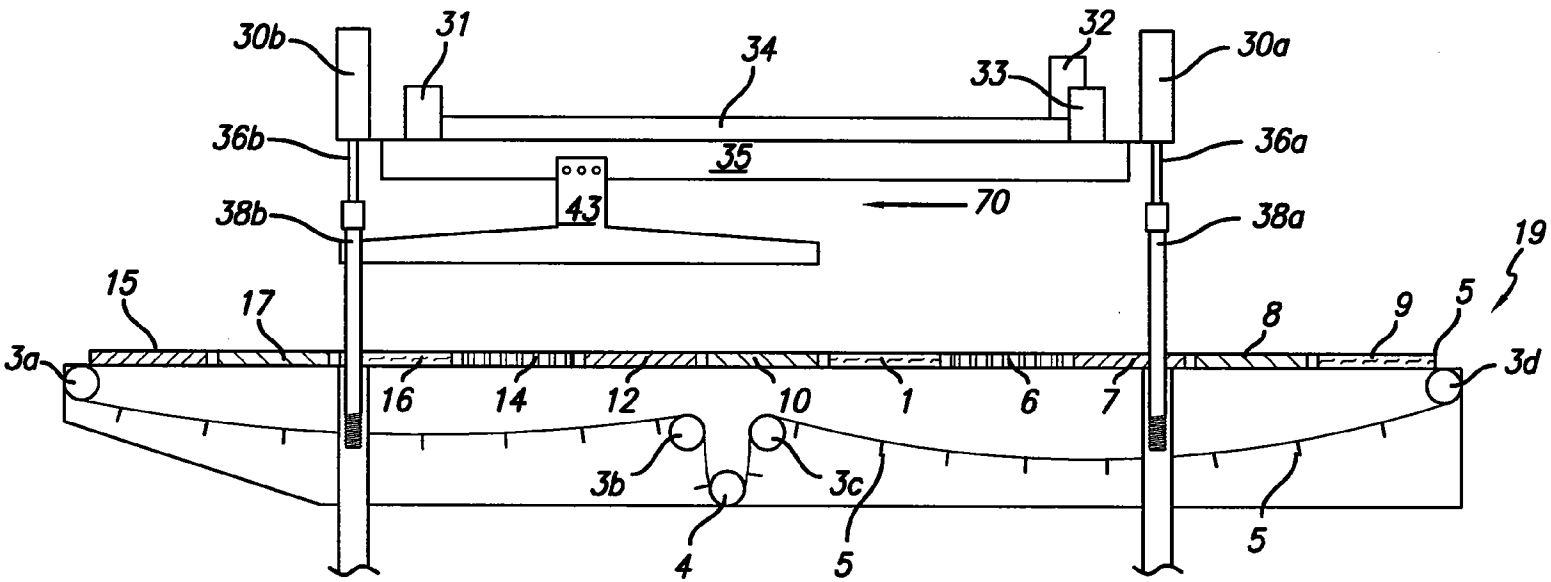
FIG. 6A illustrates a side elevation view of the apparatus shown in FIG. 1A. The actuators shown in FIGS. 1C and 2C have been re-positioned in a home position after having released the extracted and repositioned units shown in FIG. 5B.
Figure 6B:
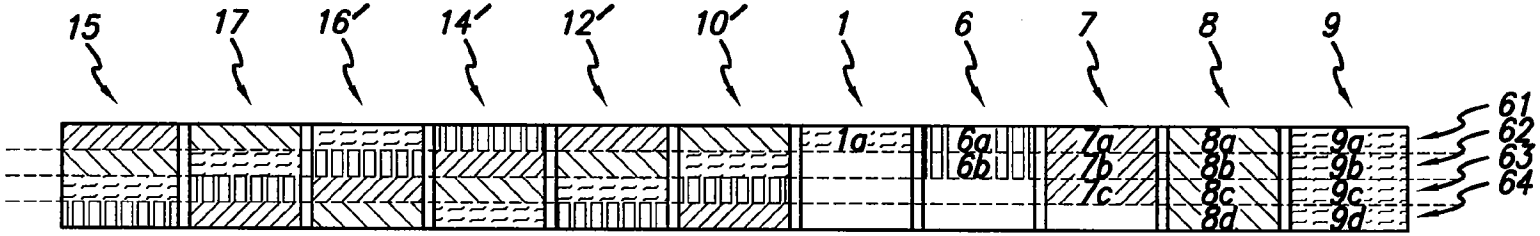
FIG. 6B illustrates a top plan view of the sequence of packages shown in FIG. 2B after combining several single-variety groups into variety packs.

In FIGS. 6A, 6B, the apparatus is shown in a home position, having completed one iteration of a shuffling method and packaging variety packs 10', 12', 14', 16'. The actuators 41, 42, 43 have returned to the home position 70, and the arrays of units shown engaged in FIGS. 4A and 5A have been released and deposited into the respective variety packs 10', 12', 14', 16'. In some instances, the units shown engaged in FIG. 5A can simply be "dropped" from the actuators 41, 42, 43 while the carriage 35 remains in an elevated position, such as by releasing a vacuum from the respective suction cups. In other instances, the carriage 35 can be lowered, placing the units in the respective variety packs, before the actuators release the units.

Exemplary Methods

Exemplary combinatorial methods for shuffling units from among a plurality of packages will now be described. For ease of explanation, the first exemplary method will be described in the context of combining units of four different varieties 20, 22, 24, 26 (see FIGS. 1B and 2B) from four respective single-variety packages 10, 12, 14, 16 into one variety pack 16' (see FIG. 6B). A second exemplary method will be described in the context of combining units of the four varieties taken from seven single-variety packages 1, 6, 7, 10, 12, 14 and 16 (see FIG. 2B) into four variety packs 10', 12', 14' and 16' (see FIG. 6B). The exemplary apparatus illustrated in FIGS. 1A, 2A, 3A, 4A, 5A and 6A (as well as at least one working embodiment) can implement such methods. Although these exemplary methods are described in the context of combining units of four different varieties into one and four variety packs, these methods can be adapted to combine substantially any number of different varieties into substantially any number of variety packs, as will also be described more fully below.

In FIG. 1B, the packages 12, 14, 16 are partially-full, and each can be a single-variety package, as shown, or a variety pack. These packages can have units removed manually (as in performing these methods for a new sequence of packages), or these packages can have units removed as part of performing these methods, as should become apparent. Packages 1 and 10 are full and can also be single-variety packages, as shown in FIG. 1B, or can be variety packs. The position of the sequence of packages shown in FIG. 1B can be referred to as a "package home position," and is substantially identical to the arrangement of packages upon completion of the method, as shown in FIG. 6B.

The single-variety packages 1, 10, 12, 14, 16 are arranged in a repeating order of variety (e.g., the first single-variety package 16 contains a first variety 20 of unit 21*a*, the second single-variety package 14 contains two groups 22*a*, 22*b* of a second variety 22 of unit 21*b*, the third single-variety package 12 contains three groups 24*a*, 24*b*, 24*c* of a third variety 24 of unit 21*c*, the fourth single-variety package 10 (which is full) contains four groups 26*a*, 26*b*, 26*c*, 26*d* of a fourth variety 26 of unit 21*d*, and the fifth single-variety package 1 (which is also full) contains four groups of units of the first variety 20). The packages 15, 17, 18 are variety packs having been packaged according to the second exemplary method (described below), and each has one group of each variety 20, 22, 24 and 26 packaged together.

As shown in FIG. 1B, each package in the series of packages 1, 10, 12, 14, 15, 16, 17, 18 spans four lanes 61, 62, 63, 64 extending among the packages. As shown in FIG. 1B, each of these packages has at least one group of units (e.g., 20*a*, 22*b*, 24*c*, 26*d*) positioned within a respective lane.

For example, the first single-variety package 16 has a first group 20*a* of units 21*a* positioned in the first lane 61, and leaves the remaining lanes 62, 63, 64 vacant. The second single-variety package 14 has a first group 22*a* of units positioned in the first lane 61 and a second group of units 22*b* positioned in the second lane 62, with lanes 63, 64 vacant. Similarly, the third single-variety package 12 has first, second and third groups 24*a*, 24*b*, 24*c* positioned in the first, second and third lanes 61, 62, 63, respectively, leaving the fourth lane 64 vacant. The fourth single-variety package 10 has first, second, third and fourth groups 24*a*, 24*b*, 24*c*, 24*d* positioned in the first, second, third and fourth lanes 61, 62, 63, 64, respectively.

With the first 16, second 14, third 12 and fourth 10 packages configured in the manner shown in FIG. 1B, shifting the second group 22*b* of the second package 14 to the first package 16 and within the second lane 62 can place two varieties of units in the same package 16. Similarly, shifting the third group 24*c* of the third package 12 to the first package 16 and within the third lane 63 can place a third variety of unit in the same package 16, and shifting the fourth group 26*d* of the fourth package 10 to the first package 16 and within the fourth lane 64 can place a fourth variety of unit in the same package 16, completing the variety pack 16' shown in FIG. 6B, and having four distinct varieties of units in a single package.

Figure 5B:
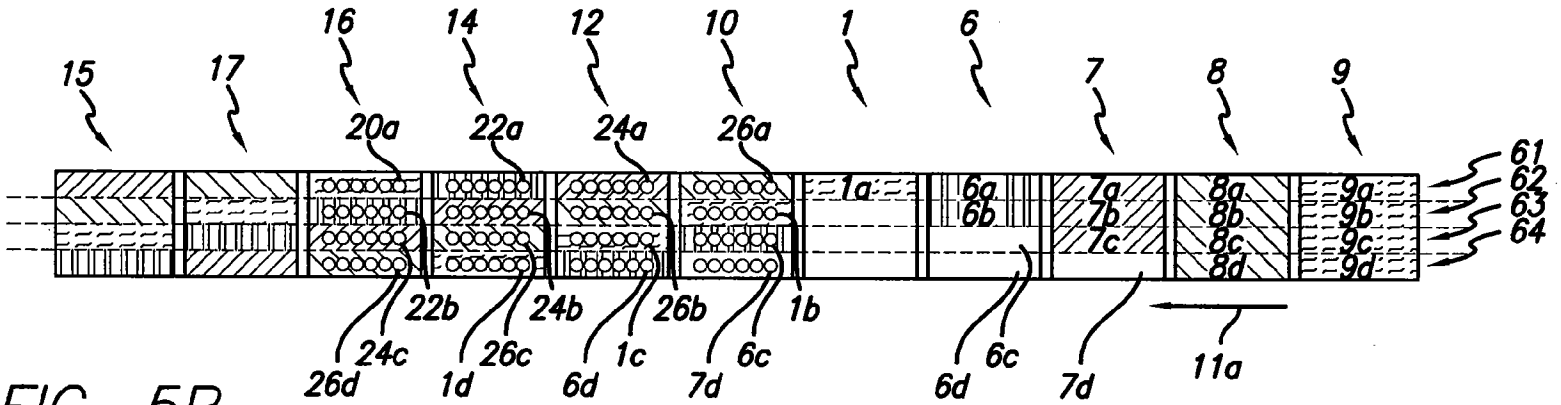
FIG. 5B illustrates a top plan view of the sequence of single-variety packages shown in FIG. 4B. The extracted units are shown repositioned relative to the single-variety packages from which they were extracted, as in FIG. 5A.

The just described method of combining one group from each of four single-variety packages into one variety pack can be expanded to form four variety packs substantially simultaneously, e.g., the four variety packs 10', 12', 14', 16' shown in FIGS. 5B and 6B. For example, rather than merely shifting one respective group from each of the second, third and fourth packages to the first package 16, three arrays having four groups each can be shifted (to the left in FIG. 1B), as more fully described below.

FIG. 1B illustrates a series of packages positioned in a package home position and arranged in a repeating order of variety. Each of the packages 12, 14 and 16 have had one or more groups of units removed.

Figure 2B:
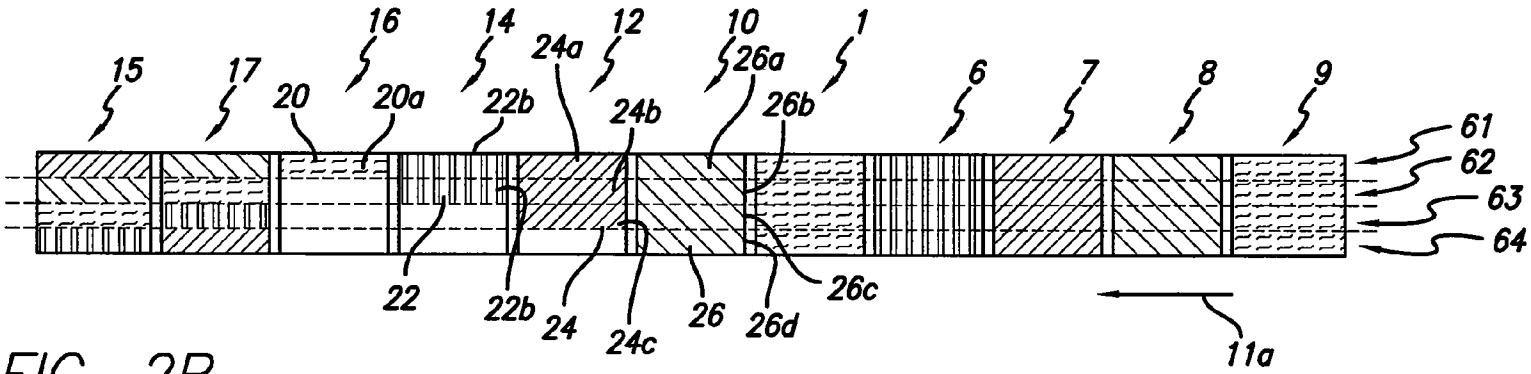
FIG. 2B illustrates a top plan view of the sequence of single-variety packages shown in FIG. 1B. The sequence is shown after advancing to a selection position.

FIG. 2B shows the sequence of packages shown in FIG. 1B after advancing in the direction of the arrow 11*a* to a package selection position. Also shown in FIG. 2B are several additional single-variety packages 6, 7, 8, 9 continuing the sequence of packages 16, 14, 12, 10, 1 being arranged in a repeating order of variety. Since these packages are arranged in a repeating order of variety, the first package 16, the fifth package 1 and the ninth package 9 of the illustrated sequence of packages each contain the first variety 20 of unit. The second package 14 and the sixth package 6 contain the second variety 22 of unit. Similarly, the third package 12 and the seventh package 7 contain the third variety 24 of unit, and the fourth package 10 and the eighth package 8 contain the fourth variety 26 of unit.

Figure 3B:
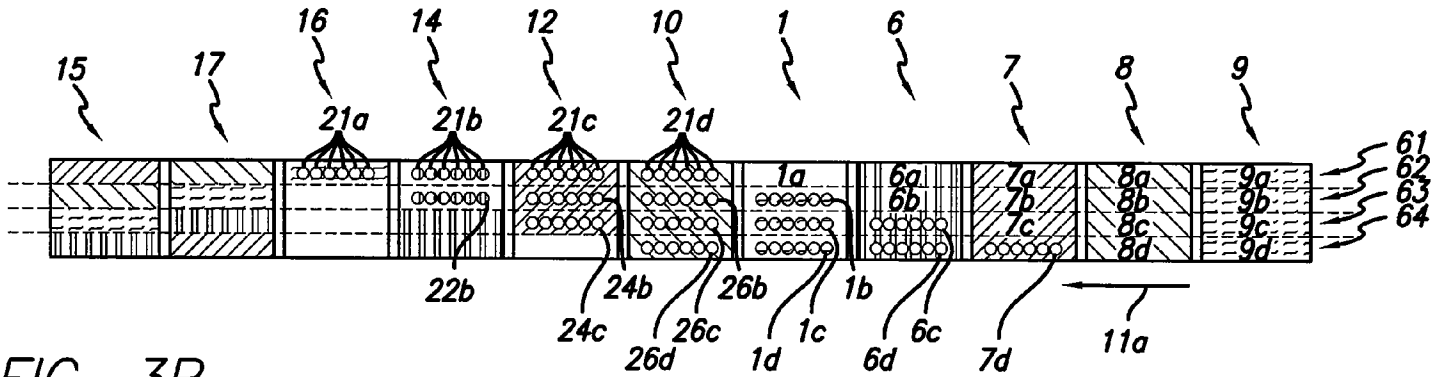
FIG. 3B illustrates a top plan view of the sequence of single-variety packages shown in FIG. 2B, with units having been selected.
Figure 4B:
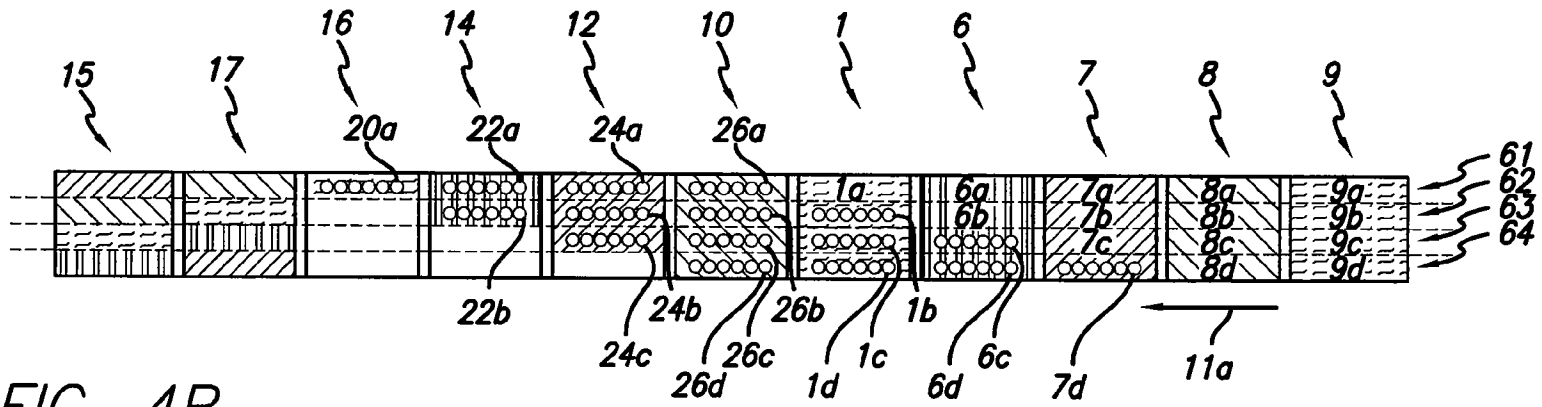
FIG. 4B illustrates a top plan view of the sequence of single-variety packages shown in FIG. 3B with the selected units having been extracted from the respective packages.

FIGS. 3B and 4B illustrate the sequence of packages in the selection position shown in FIG. 2B. Also shown in FIGS. 3B and 4B are selected groups of individual units (e.g., groups 20*a*, 22*a*, 22*b*, 24*a*, 24*b*, 24*c*, 26*a*, 26*b*, 26*c*, 26*d*, 1*b*, 1*c*, 1*d*, 6*c*, 6*d* and 7*d*) for combining into variety packs, as well as unselected groups of units being in a subsequent home position (e.g., groups 1*a*, 6*a*, 6*b*, 7*a*, 7*b*, 7*c*, 8*a*, 8*b*, 8*c* and 8*d*), as shown in, for example, FIGS. 5B and 6B.

The selected groups in the first lane 61, i.e., groups 20*a*, 22*a*, 24*a* and 26*a*, form a first array that remains statically positioned and unengaged by a shifting mechanism. The selected groups in the second lane 62, i.e., groups 22*b*, 24*b*, 26*b* and 1*b*, form a second array. Similarly, the selected groups in the third lane 63, i.e., groups 24*c*, 26*c*, 1*c* and 6*c*, form a third array, and the selected groups in the fourth lane 64, i.e., groups 26*d*, 1*d*, 6*d* and 7*d*, form a fourth array. Although each of these groups is shown in the drawings as having six individual units, the methods described herein can be applied to groups having substantially any number of individual units.

The first selected array does not shift in this example. Shifting the second array by one package (as by engagement by and advancement of an actuator), shifting the third array by two packages and shifting the fourth array by three packages can provide four variety packs 10', 12', 14', 16' (see FIG. 6B) with each variety pack having one group of each of the four varieties.

For example, shifting the second array by one package in the direction of the arrow 11*a* can place the group 22*b* adjacent the group 20*a*, the group 24*b* adjacent the group 22*a*, the group 26*b* adjacent the group 24*a*, and the group 1*b* adjacent the group 26*a*. Accordingly, each of the packages 10, 12, 14 and 16 can have two varieties of units by shifting the second array by a distance spanned by one package in the direction of the arrow 11*a*.

Similarly, shifting the third array by a distance spanned by two packages in the direction of the arrow 11*a* can place the group 24*c* adjacent the group 22*b*, the group 26*c* adjacent the group 24*b*, the group 1*c* adjacent the group 26*b*, and the group 6*c* adjacent the group 1*b*. Accordingly, each of the packages 10, 12, 14 and 16 can contain a third variety of unit by shifting the third array by two packages in the direction of the arrow 11*a*.

Shifting the fourth array by a distance spanned by three packages in the direction of the arrow 11*a* can place the group 26*d* adjacent the group 24*c*, the group 1*d* adjacent the group

26*c*, the group 6*d* adjacent the group 1*c*, and the group 7*d* adjacent the group 6*c*. Accordingly, each of the packages 16, 14, 12 and 10 can contain a fourth variety of unit by shifting the fourth array by three packages in the direction of the arrow 11*a*.

The shuffling method just described (e.g., shuffling four four-group arrays) can be applied to a sequence of packages having a four-member sub-sequence that repeats a variety (e.g., a sub-sequence where packages 14 and 16 contain the same variety, package 12 contains a second variety and package 10 comprises a third variety, and this sub-sequence repeats for packages 1, 6, 7 and 8). Since only three varieties of units would be present in such a sequence of packages, the resulting variety packs would contain at most three varieties of units. Still, the resulting variety packs 10', 12', 14' and 16' can have two groups of the repeated variety, and one group of each of the other distinct varieties.

By way of example, the methods of shuffling four arrays as just described can be applied to single-flavor cases of beverages that are each arranged in a 4×6 configuration. For example, the sequence of packages 16, 14, 12, 10, 1, 6, 7 arranged in a repeating order of variety in FIG. 2B can be a sequence of beverage cases. These beverage cases can be configured to hold 24 bottles of a flavored-water beverage in a 4×6 arrangement. Each of the cases can contain one of four flavors of beverage, and each resulting variety pack can contain six bottles of each of the four flavors.

With regard to FIG. 3B, each of the packages 1, 6, 7, 8 and 10 can be full of beverage bottles, such that each lane 61, 62, 63, 64 contains six bottles from each of the full cases. Upon shifting of the arrays as described above, package 1 can have one group of beverages, package 6 can have two groups of beverages, package 7 can have three groups of beverages, and package 8 can remain full (see FIGS. 5B and 6B). Accordingly, packages 1, 6, 7 and 8 are in a package home position, similar to that shown in FIG. 1B, and can be subsequently advanced to a selection position, as shown in FIG. 2B, to receive a next iteration of shifted arrays.

General Method

Generalized embodiments of shuffling methods will now be described with reference to FIGS. 7A, 7B and 7C.

Figure 7A:
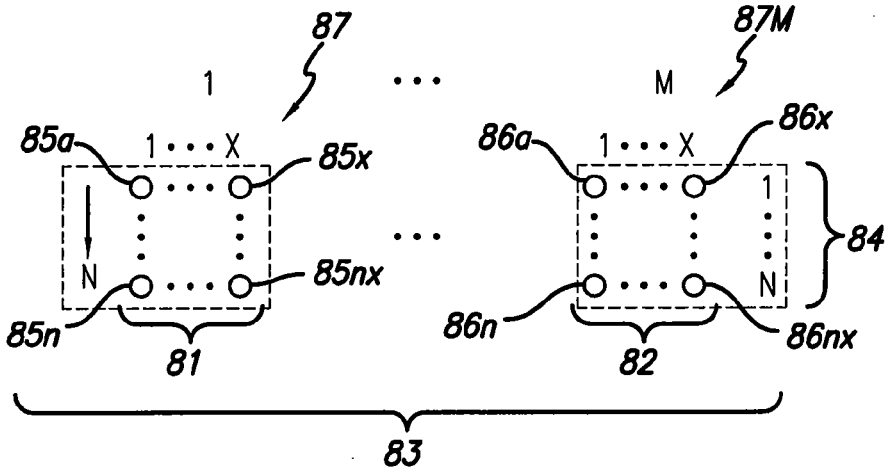
FIG. 7A illustrates a sub-sequence of an arbitrary number, M, of packages, each package having units arranged in an N×X configuration.

FIG. 7A illustrates a sub-sequence 83 of an arbitrary number, M, of packages 87 . . . 87*m*, with each package having units arranged in an N×X configuration. For example, the first package 87 has N groups of X individual units (e.g., units 85*a* . . . 85*x* form a first group of X units, units 85*n* . . . 85*nx* form an $N^{th}$ group 81 of X units). The sub-sequence 83 comprises a total of M packages 87 . . . 87*m*. The $M^{th}$ package 87*m* also has N groups of X individual units (e.g., units 86*a* . . . 86*x* form a first group of X units, units 86*n* . . . 86*nx* form an $N^{th}$ group 82 of X units).

The packages 87 . . . 87*m* and their respective groups of units are aligned to form several lanes 84. For example, the packages 87 . . . 87*m* are positioned such that the first group of X units (e.g., units 85*a* . . . 85*x*, units 86*a* . . . 86*x*) from each package 87 . . . 87*m* lies within the first lane, and the $N^{th}$ group of X units (e.g., units 85*n* . . . 85*nx*, units 86*n* . . . 86*nx*) lie within the $N^{th}$ lane. To generalize the alignment of the groups, the $h^{th}$ group of each package 87 . . . 87*m* lies within the $h^{th}$ lane, where h is an integer ranging from 1 to N.

In some embodiments of the general method, each of the packages 87 . . . 87*m* is a single-variety package with each having a unique variety of unit relative to the other (M−1) packages. In other words, the sub-sequence 83 can comprise M different varieties of units, with each distinct variety packaged in a single-variety package. In other embodiments, each of the M packages 87 . . . 87*m* is a single-variety package, but one or more of these single-variety packages contain a variety of unit that is the same or substantially the same as one or more of the other (M−1) packages. In still other embodiments, one or more of the M packages 87 . . . 87*m* is a variety pack.

Figure 7B:
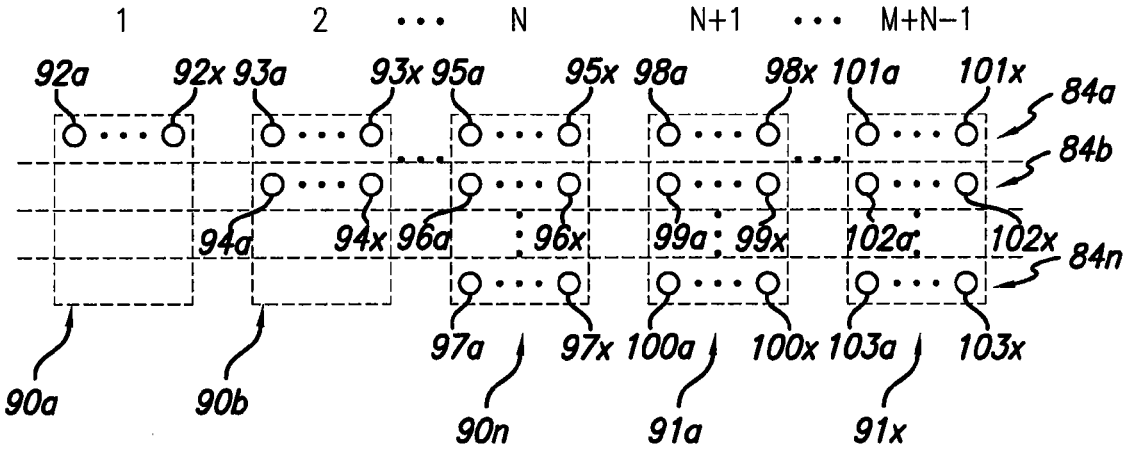
FIG. 7B illustrates a sequence of packages positioned in a selection position and arranged to provide M shuffled sets in accordance with a general shuffling method as disclosed herein.

FIG. 7B illustrates a sequence of M+N−1 single-variety packages 90*a*, 90*b* . . . 90*n*, 91*a* . . . 91*x* arranged in a repeating order of variety of N varieties and positioned in a selection position spanning N lanes 84*a* . . . 84*n*. As in FIG. 7A, the $h^{th}$ group of each of the M+N−1 packages 90*a*, 90*b* . . . 90*n*, 91*a* . . . 91*x* lies within the $h^{th}$ lane, where h is an integer ranging from 1 to N.

In addition, each of the first N packages 90*a* . . . 90*n* comprises the same number of groups of units as the package's position in the sequence of packages. For example, the first package 90*a* has one group of units 92*a* . . . 92*x*, the second package 90*b* has two groups of units 93*a* . . . 93*x* and 94*a* . . . 94*x*, and so on through the $N^{th}$ package having N groups of units (e.g., 95*a* . . . 95*x*, 96*a* . . . 96*x*, . . . , 97*a* . . . 97*x*). In other words, each $i^{th}$ package in the sequence shown in FIG. 7B has i groups of units, where i is an integer ranging from 1 to N.

Each of the subsequent packages (e.g., each $k^{th}$ package, where k is an integer ranging from N+1 to M+N−1) in the sequence comprises N groups of units (e.g., is full). For example, the $(N+1)^{th}$ package 91*a* comprises N groups of units 98*a* . . . 98*x*, 99*a* . . . 99*x*, . . . , 100*a* . . . 100*x*, as does the $(M+N-1)^{th}$ package 91*x*.

Figure 7C:
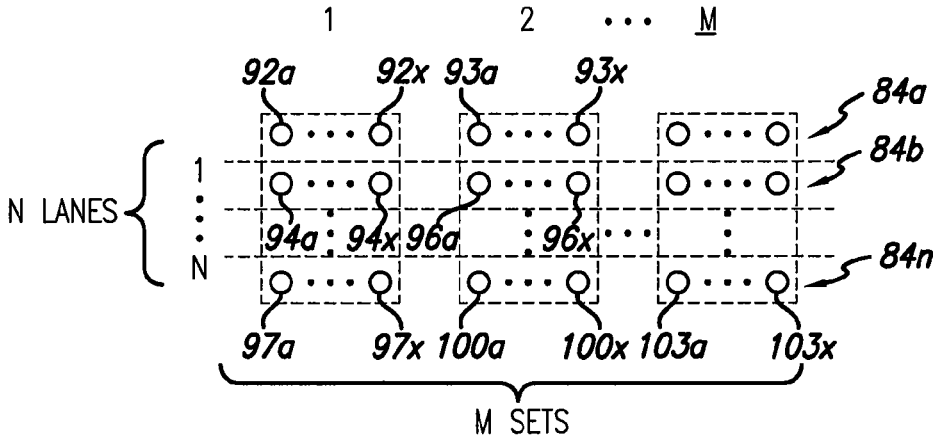
FIG. 7C illustrates M shuffled sets having been combined in accordance with a general shuffling method as disclosed herein.

A sequence of packages located in a selection position as shown in FIG. 7B can be shuffled to provide up to M shuffled sets of N varieties, such as the M sets shown in FIG. 7C. For example, an array of M groups of units selected from each of the (N−1) lanes 84*b* . . . 84*n* can be shifted (to the left in FIG. 7B) by a distance spanned by the same number of packages as the lane number (e.g., the first selected array corresponding to a first lane 84*b* can be shifted to the left by a distance spanned by one package; an $(N-1)^{th}$ array corresponding to an $(N-1)^{th}$ lane 84*n* can be shifted to the left by a distance spanned by (N−1) packages). In other words, a $j^{th}$ array of M groups of units, which corresponds to a $j^{th}$ lane, can be shifted (to the left in FIG. 7B) by a distance spanned by j packages, where j is an integer ranging between 1 and (N−1). For example, one variety pack (M=1) of N varieties of units can be obtained by shifting one group of units from each of the (N−1) lanes 84*b* . . . 84*n* to the package 90*a*. Similarly, two variety packs (M=2) of N varieties of units can be obtained by shifting one group of units from each of the (N−1) lanes 84*b* . . . 84*n* to the package 90*a*, and shifting a second group of units from (N−2) lanes (e.g., each of the lanes except the first two lanes 84*a*, 84*b*) to the second package in the sequence, package 90*b*.

Other Embodiments

The above described apparatus (see FIGS. 1A, 2A, 3A, 4A, 5A, 6A and the related discussion) can be used to combine four varieties of beverage from seven respective single-variety packages 16, 14, 12, 10, 1, 6, and 7 (see FIG. 2B) into four variety packs 16', 14', 12', 10' (see FIG. 5B). But such apparatus are not limited to only four varieties of beverages or four variety packs. Such apparatus can be adapted to implement any of the methods disclosed herein, including those methods disclosed with reference to FIGS. 7A, 7B and 7C.

For example, such apparatus can have (N−1) horizontally movable actuators aligned with a corresponding number of (N−1) lanes extending among a sequence of packages positioned on the conveyor 19. In some embodiments, each actuator can be configured to return to a release position simultaneously (or substantially simultaneous) by moving each $j^{th}$ actuator corresponding to each respective $j^{th}$ lane, by j-times the speed of a first actuator, where j is an integer ranging between 1 and (N−1). For large numbers of lanes, moving a $j^{th}$ actuator at j-times the speed of the first actuator might be impractical. In such instances, at least some of the actuators can be, but need not be, returned to the release position at different times, as by, for example, moving one or more of the actuators at about the same speed.

Throughout, this disclosure makes reference to the accompanying drawings which form a part hereof, wherein like numerals designate like parts. The drawings illustrate specific embodiments, but other embodiments may be formed and structural changes may be made without departing from the intended scope of this disclosure. For example, in each illustrated embodiment, the respective first lanes 61 (FIG. 1B), 84*a* (FIG. 7B) are shown at the top row and the respective second lanes 62, 84*b* are shown adjacent the first lanes. However, any of the lanes can be populated as a first lane, and any remaining lane can be populated as a second lane, and so forth, without departing from the disclosed concepts. Directions and references (e.g., up, down, top, bottom, left, right, rearward, forward, etc.) have been used to facilitate discussion of the drawings but are not intended to be limiting. For example, certain terms may have been used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" as well as "and" and "or."

Accordingly, this detailed description shall not be construed in a limiting sense, and following a review of this disclosure, those of ordinary skill in the art will appreciate the wide variety of goods, materials and/or physical articles that can be combined into variety packs using the various apparatus and various methods described herein. Moreover, those of ordinary skill in the art will appreciate that the exemplary methods and apparatus disclosed herein can be adapted to provide variety packs comprising almost any number of single-variety groups having almost any number of individual units.

In view of the many possible embodiments to which the principles of the disclosed innovations can be applied, it should be recognized that the above-described embodiments are only examples and should not be taken as limiting the scope of what is claimed. Rather, the scope of what is claimed is set forth in the following claims. I therefore claim as my invention all that comes within the scope and spirit of these claims.

I claim:

1. A method for shuffling and combining units from among a plurality of packages of different types of units moving along a conveyor, the method comprising:

providing a plurality of packages with one type of unit in each package moving along the conveyor, the plurality of packages defining at least two lanes extending among the plurality of packages moving along the conveyor, wherein each package contains one or more units positioned within at least one of the lanes;

selecting at least one of the one or more units from a package as at least one group of units, the at least one group of units being made up of fewer than all of the units in the package;

repositioning the selected at least one group of units to another package moving along the conveyor, wherein the selection and repositioning of units results in the formation of a plurality of packages that have more than one type of unit within each package;

wherein the act of selecting the at least one group of units comprises the act of selecting at least one array of single-variety groups of units, the number of selected arrays being one fewer than the number of lanes, and the act of repositioning the selected at least one group of units comprises the act of shifting the selected arrays of groups within each corresponding lane by an amount that is different for selected array.

2. The method of claim 1, wherein the at least one array of single-variety groups of units comprises at least four single-variety groups of units.

3. The method of claim 2, wherein each of the single-variety groups of units comprises a distinct variety of unit.

4. The method of claim 1, wherein the act of selecting at least one array comprises selecting at least two arrays.

5. The method of claim 4, wherein each of the arrays comprises at least two groups of units.

6. The method of claim 5, wherein each of the groups of units corresponding to a given one of the arrays comprises a distinct variety of unit.

7. The method of claim 1, wherein the act of repositioning the selected at least one single-variety group of units comprises:

engaging the selected at least one single-variety group of units;

lifting the selected at least one single-variety group of units;

shifting the selected at least one group of units from above one package position to above another package position; and releasing the selected at least one group of units.

8. The method of claim 1, wherein the plurality of packages comprises at least seven single-variety packages.

9. The method of claim 1, wherein the act of selecting at least one array comprises selecting at least three arrays.

10. The method of claim 9, wherein each of three of the at least three arrays comprises four single-variety groups of units.

11. The method of claim 10, wherein each single-variety group of units comprises six units.

12. The method of claim 1, wherein at least one of the at least one array comprises four single-variety groups of units.

13. The method of claim 12, wherein each single-variety group of units comprises six units.

14. The method of claim 1, further comprising:

aligning at least one of the at least one array with at least one other array; and releasing the at least one array to form at least one variety pack.

15. The method of claim 1, wherein the act of repositioning further comprises:

substantially simultaneously releasing each of the selected arrays of groups.

16. The method of claim 15, wherein the act of shifting each of the selected arrays further comprises:

shifting an $(N-1)^{th}$ array by about a distance spanned by (N−1) groups, wherein N is the number of lanes.

17. The method of claim 16, wherein the act of shifting the first array comprises translating the first array at a first speed, and wherein the act of shifting the $(N-1)^{th}$ array comprises translating the $(N-1)^{th}$ array at a speed being about (N−1) times the first speed.

18. The method of claim 1, wherein the act of shifting each of the selected arrays comprises shifting a first array by about a distance spanned by one group and shifting a second array by about a distance spanned by two groups.

19. The method of claim 18, wherein the act of shifting a first array by about a distance spanned by one group and shifting a second array by about a distance spanned by two groups comprises:

translating the first array at a first speed; and translating the second array at a speed being about twice the first speed.

* * * * *